US008854349B2

(12) United States Patent
Eom

(10) Patent No.: US 8,854,349 B2
(45) Date of Patent: Oct. 7, 2014

(54) DISPLAY DEVICE AND METHOD OF DRIVING THE SAME

(75) Inventor: Ki-Myeong Eom, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 416 days.

(21) Appl. No.: 12/960,391

(22) Filed: Dec. 3, 2010

(65) Prior Publication Data

US 2011/0141091 A1 Jun. 16, 2011

(30) Foreign Application Priority Data

Dec. 11, 2009 (KR) ..... 10-2009-0123320

(51) Int. Cl.
*G09G 5/00* (2006.01)
*G09G 3/32* (2006.01)

(52) U.S. Cl.
CPC ..... *G09G 3/3233* (2013.01); *G09G 2310/0232* (2013.01); *G09G 3/3266* (2013.01); *G09G 2310/0286* (2013.01); *G09G 2310/0218* (2013.01); *G09G 2310/04* (2013.01); *G09G 2330/021* (2013.01)
USPC ..... 345/211; 345/100

(58) Field of Classification Search
USPC ..... 345/76–83, 87–104, 60, 204, 690, 211
See application file for complete search history.

(56) References Cited

U.S. PATENT DOCUMENTS

2006/0061535 A1* 3/2006 Kim et al. ..... 345/98
2008/0079676 A1* 4/2008 Pak et al. ..... 345/87

FOREIGN PATENT DOCUMENTS

JP 2008-209690 9/2008
KR 10-2008-0030795 4/2008
KR 10-2008-0048223 A 6/2008

* cited by examiner

*Primary Examiner* — Stephen Sherman
(74) *Attorney, Agent, or Firm* — Christie, Parker & Hale, LLP

(57) ABSTRACT

A display device that can reduce power and simplify a manufacturing process includes a display unit and a scan driver. The display unit includes a plurality of scan lines, a plurality of data lines, and a plurality of pixels. The scan lines are configured to receive a plurality of scan signals. The scan driver is configured to receive a synchronization signal that is generated in synchronization with a vertical synchronization signal, a first light emitting clock signal, a second light emitting clock signal representing the first light emitting clock signal shifted by a half cycle, a first initialization signal having a first phase delay relative to the second light emitting clock signal, and a second initialization signal having a second phase delay relative to the first light emitting clock signal. The scan driver is configured to generate a plurality of sequential driving signals and the plurality of scan signals.

19 Claims, 7 Drawing Sheets

DISPLAY DEVICE AND METHOD OF DRIVING THE SAME

CROSS-REFERENCE TO RELATED APPLICATION(S)

This application claims priority to and the benefit of Korean Patent Application No. 10-2009-0123320, filed in the Korean Intellectual Property Office on Dec. 11, 2009, the entire content of which is incorporated herein by reference.

BACKGROUND

1. Field

Aspects of embodiments according to the present invention relate to a display device and a method of driving the same.

2. Description of the Related Art

A display device includes a display unit that is formed with a plurality of pixels that are arranged in a matrix form. A display unit includes a plurality of scan lines that are formed to extend in a row direction and a plurality of data lines that are formed to extend in a column direction, and the plurality of scan lines and the plurality of data lines are arranged to cross each other. Each of a plurality of pixels is driven by a scan signal and a data signal that are transferred from a corresponding scan line and data line.

A display device may be classified, for example, as a passive matrix light emitting display or an active matrix light emitting display according to a driving method of a pixel. An active matrix light emitting display that selectively emits light from each unit pixel is more desirable from a resolution, contrast, and operation speed viewpoint.

Such a display device can be used as a display device for a portable information terminal such as a personal computer, a mobile phone, or a personal digital assistant (PDA), or as a monitor for various information appliances. A liquid crystal display (LCD) that uses a liquid crystal panel, an OLED display that uses an organic light emitting element, and a plasma display panel (PDP) that uses a plasma panel are widely known examples of such display devices. Various light emitting display devices having a small weight and volume when compared with comparable cathode ray tube (CRT) devices have been developed, and particularly, an OLED display having relatively high light emitting efficiency, luminance, and viewing angle as well as a rapid response speed has been in the spotlight.

However, in a display unit of a display device, a period in which the display unit is divided into a display area and a non-display area may exist. However, during the period, scan signals and data signals may still be supplied to all scan lines and data lines in the display unit. This can cause unnecessary power consumption and thus, there may be a problem that power consumption increases compared to the power needed to drive the display area.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed toward a display device and a method of driving the same capable of reducing power consumption and simplifying a manufacturing process.

In an exemplary embodiment according to the present invention, a display device is provided. The display device includes a display unit and a scan driver. The display unit includes a plurality of scan lines configured to receive a plurality of scan signals, a plurality of data lines configured to receive a plurality of data signals, and a plurality of pixels coupled to the plurality of scan lines and the plurality of data lines. The scan driver is configured to receive a synchronization signal generated in synchronization with a vertical synchronization signal, a first light emitting clock signal, a second light emitting clock signal representing the first light emitting clock signal shifted by a half cycle, a first initialization signal having a first phase delay relative to the second light emitting clock signal, and a second initialization signal having a second phase delay relative to the first light emitting clock signal. The scan driver is configured to generate a plurality of sequential driving signals and the plurality of scan signals. The scan driver is further configured to generate respective ones of the plurality of scan signals as an on-voltage level by respective ones of the plurality of sequential driving signals corresponding to a display area according to an area selection signal that divides the display unit into the display area and a non-display area. The scan driver is also further configured to generate respective ones of the plurality of scan signals as an off-voltage level corresponding to the non-display area according to an inverted area selection signal.

The plurality of scan signals may include a plurality of first scan signals and a plurality of second scan signals. The plurality of sequential driving signals may include a plurality of first sequential driving signals and a plurality of second sequential driving signals. The scan driver may include a plurality of first sequential drivers, a plurality of second sequential drivers, a plurality of first output selection portions, and a plurality of second output selection portions. Each of the plurality of first sequential drivers is configured to be synchronized with the first light emitting clock signal and configured to output one of the second light emitting clock signal or a voltage of a first power source as a respective one of the plurality of first sequential driving signals according to a first input signal and the first initialization signal. Each of the plurality of second sequential drivers is configured to be synchronized with the second light emitting clock signal and configured to output one of the first light emitting clock signal or the first power source voltage as a respective one of the plurality of second sequential driving signals according to a second input signal and the second initialization signal. Each of the plurality of first output selection portions is configured to output one of the first light emitting clock signal or the first power source voltage as a respective one of the plurality of first scan signals according to a corresponding one of the plurality of first sequential driving signals, the area selection signal, the inverted area selection signal, and the second initialization signal. Each of the plurality of second output selection portions is configured to output one of the second light emitting clock signal or the first power source voltage as a respective one of the plurality of second scan signals according to a corresponding one of the plurality of second sequential driving signals, the area selection signal, the inverted area selection signal, and the first initialization signal.

Each of the plurality of first sequential drivers may be configured to receive, as the first input signal, the synchronization signal or a corresponding immediately preceding one of the plurality of second sequential driving signals.

Each of the plurality of first sequential drivers may include first through sixth transistors and first and second capacitors. The first transistor includes a gate terminal configured to receive the first light emitting clock signal, a first terminal, and a second terminal configured to receive the first input signal. The second transistor includes a gate terminal configured to receive the first input signal, a first terminal coupled to the first power source, and a second terminal. The third transistor includes a gate terminal coupled to the second terminal of the second transistor, a first terminal coupled to the first power source, and a second terminal. The first capacitor includes one terminal coupled to the first power source and an other terminal coupled to the gate terminal of the third transistor. The fourth transistor includes a gate terminal coupled to the other terminal of the first capacitor, a first terminal coupled to the first power source, and a second terminal. The fifth transistor includes a gate terminal configured to receive the first initialization signal, a first terminal coupled to the other terminal of the first capacitor, and a second terminal coupled to a second power source. The second capacitor includes one terminal coupled to the second terminal of the fourth transistor and an other terminal coupled to the second terminal of the third transistor. The sixth transistor includes a gate terminal coupled to the one terminal of the second capacitor, a first terminal coupled to the other terminal of the second capacitor, and a second terminal configured to receive the second light emitting clock signal.

Each of the plurality of second sequential drivers may be configured to receive, as the second input signal, a corresponding immediately preceding one of the plurality of first sequential driving signals.

Each of the plurality of second sequential drivers may include first through sixth capacitors and first and second capacitors. The first transistor includes a gate terminal configured to receive the second light emitting clock signal, a first terminal, and a second terminal configured to receive the second input signal. The second transistor includes a gate terminal configured to receive the second input signal, a first terminal coupled to the first power source, and a second terminal. The third transistor includes a gate terminal coupled to the second terminal of the second transistor, a first terminal coupled to the first power source, and a second terminal. The first capacitor includes one terminal coupled to the first power source and an other terminal coupled to the gate terminal of the third transistor. The fourth transistor includes a gate terminal coupled to the other terminal of the first capacitor, a first terminal coupled to the first power source, and a second terminal. The fifth transistor includes a gate terminal configured to receive the second initialization signal, a first terminal coupled to the other terminal of the first capacitor, and a second terminal coupled to a second power source. The second capacitor includes one terminal coupled to the second terminal of the fourth transistor and an other terminal coupled to the second terminal of the third transistor. The sixth transistor includes a gate terminal coupled to the one terminal of the second capacitor, a first terminal coupled to the other terminal of the second capacitor, and a second terminal configured to receive the first light emitting clock signal.

Each of the plurality of first output selection portions may include first through ninth transistors and first and second capacitors. The first transistor includes a gate terminal configured to receive the area selection signal, a first terminal configured to receive a corresponding one of the first sequential driving signals, and a second terminal. The second transistor includes a gate terminal configured to receive the inverted area selection signal, a first terminal coupled to the first power source, and a second terminal coupled to the second terminal of the first transistor. The third transistor includes a gate terminal coupled to the second terminal of the second transistor, a first terminal coupled to the first power source, and a second terminal. The fourth transistor includes a gate terminal configured to receive the second light emitting clock signal, a first terminal coupled to the second terminal of the second transistor, and a second terminal. The fifth transistor includes a gate terminal coupled to the second terminal of the third transistor, a first terminal coupled to the first power source, and a second terminal coupled to the second terminal of the fourth transistor. The sixth transistor includes a gate terminal configured to receive the inverted area selection signal, a first terminal coupled to the gate terminal of the fifth transistor, and a second terminal coupled to a second power source. The first capacitor includes one terminal coupled to the first power source and an other terminal coupled to the first terminal of the sixth transistor. The seventh transistor includes a gate terminal configured to receive the second initialization signal, a first terminal coupled to the other terminal of the first capacitor, and a second terminal coupled to the second power source. The eighth transistor includes a gate terminal coupled to the other terminal of the first capacitor, a first terminal coupled to the first power source, and a second terminal. The second capacitor includes one terminal coupled to the second terminal of the fifth transistor and an other terminal coupled to the second terminal of the eighth transistor. The ninth transistor includes a gate terminal coupled to the one terminal of the second capacitor, a first terminal coupled to the other terminal of the second capacitor, and a second terminal configured to receive the second light emitting clock signal.

Each of the plurality of first output selection portions may include first through eighth transistors and first and second capacitors. The first transistor includes a gate terminal configured to receive a corresponding one of the first sequential driving signals, a first terminal, and a second terminal coupled to a second power source. The second transistor includes a gate terminal configured to receive the area selection signal, a first terminal, and a second terminal coupled to the first terminal of the first transistor. The third transistor includes a gate terminal configured to receive the corresponding one of the first sequential driving signals, a first terminal coupled to the first power source, and a second terminal. The fourth transistor includes a gate terminal coupled to the second terminal of the third transistor, a first terminal coupled to the first power source, and a second terminal coupled to the first terminal of the second transistor. The fifth transistor includes a gate terminal configured to receive the inverted area selection signal, a first terminal coupled to the gate terminal of the fourth transistor, and a second terminal coupled to the second power source. The sixth transistor includes a gate terminal configured to receive the second initialization signal, a first terminal coupled to the gate terminal of the fourth transistor, and a second terminal coupled to the second power source. The first capacitor includes one terminal coupled to the first power source and an other terminal coupled to the first terminal of the sixth transistor. The seventh transistor includes a gate terminal coupled to the other terminal of the first capacitor, a first terminal coupled to the first power source, and a second terminal. The second capacitor includes one terminal coupled to the second terminal of the fourth transistor and an other terminal coupled to the second terminal of the seventh transistor. The eighth transistor includes a gate terminal coupled to the one terminal of the second capacitor, a first terminal coupled to the other terminal of the second capacitor, and a second terminal configured to receive the second light emitting clock signal.

Each of the plurality of second output selection portions may include first through ninth transistors and first and second capacitors. The first transistor includes a gate terminal configured to receive the area selection signal, a first terminal configured to receive a corresponding one of the second sequential driving signals, and a second terminal. The second transistor includes a gate terminal configured to receive the inverted area selection signal, a first terminal coupled to the first power source voltage, and a second terminal coupled to the second terminal of the first transistor. The third transistor includes a gate terminal coupled to the second terminal of the second transistor, a first terminal coupled to the first power source voltage, and a second terminal. The fourth transistor includes a gate terminal configured to receive the first light emitting clock signal, a first terminal coupled to the second terminal of the second transistor, and a second terminal. The fifth transistor includes a gate terminal coupled to the second terminal of the third transistor, a first terminal coupled to the first power source, and a second terminal coupled to the second terminal of the fourth transistor. The sixth transistor includes a gate terminal configured to receive the inverted area selection signal, a first terminal coupled to the gate terminal of the fifth transistor, and a second terminal coupled to a second power source. The first capacitor includes one terminal coupled to the first power source and an other terminal coupled to the first terminal of the sixth transistor. The seventh transistor includes a gate terminal configured to receive the first initialization signal, a first terminal coupled to the other terminal of the first capacitor, and a second terminal coupled to the second power source. The eighth transistor includes a gate terminal coupled to the other terminal of the first capacitor, a first terminal coupled to the first power source, and a second terminal. The second capacitor includes one terminal coupled to the second terminal of the fifth transistor and an other terminal coupled to the second terminal of the eighth transistor. The ninth transistor includes a gate terminal coupled to the one terminal of the second capacitor, a first terminal coupled to the other terminal of the second capacitor, and a second terminal configured to receive the second light emitting clock signal.

Each of the plurality of second output selection portions may include first through eighth transistors and first and second capacitors. The first transistor includes a gate terminal configured to receive a corresponding one of the second sequential driving signals, a first terminal, and a second terminal coupled to a second power source. The second transistor includes a gate terminal configured to receive the area selection signal, a first terminal, and a second terminal coupled to the first terminal of the first transistor. The third transistor includes a gate terminal configured to receive the corresponding one of the second sequential driving signals, a first terminal coupled to the first power source, and a second terminal. The fourth transistor includes a gate terminal coupled to the second terminal of the third transistor, a first terminal coupled to the first power source, and a second terminal coupled to the first terminal of the second transistor. The fifth transistor includes a gate terminal configured to receive the inverted area selection signal, a first terminal coupled to the gate terminal of the fourth transistor, and a second terminal coupled to the second power source. The sixth transistor includes a gate terminal configured to receive the second initialization signal, a first terminal coupled to the gate terminal of the fourth transistor, and a second terminal coupled to the second power source. The first capacitor includes one terminal coupled to the first power source and an other terminal coupled to the first terminal of the sixth transistor. The seventh transistor includes a gate terminal coupled to the other terminal of the first capacitor, a first terminal coupled to the first power source, and a second terminal. The second capacitor includes one terminal coupled to the second terminal of the fourth transistor and an other terminal coupled to the second terminal of the seventh transistor. The eighth transistor includes a gate terminal coupled to the one terminal of the second capacitor, a first terminal coupled to the other terminal of the second capacitor, and a second terminal configured to receive the second light emitting clock signal.

The display device may further include a data driver configured to transfer valid data to the plurality of data lines of the display area and to transfer invalid data to the plurality of data lines of the non-display area.

The data driver may be configured to transfer the valid data to the plurality of data lines for a period in which the area selection signal corresponding to the display area is applied, and to transfer the invalid data to the plurality of data lines for a period in which the inverted area selection signal corresponding to the non-display area is applied.

In accordance with another exemplary embodiment according to the present invention, a method of driving a display device is provided. The display device includes a display unit having a plurality of scan lines configured to receive a plurality of scan signals, a plurality of data lines configured to receive a plurality of data signals, and a plurality of pixels coupled to the plurality of scan lines and the plurality of data lines. The method includes receiving a synchronization signal that is generated in synchronization with a vertical synchronization signal, a first light emitting clock signal, a second light emitting clock signal representing the first light emitting clock signal shifted by a half cycle, a first initialization signal having a first phase delay relative to the second light emitting clock signal, and a second initialization signal having a second phase delay relative to the first light emitting clock signal; generating a plurality of sequential driving signals; and generating the plurality of scan signals. The generating of the plurality of scan signals includes generating respective ones of the plurality of scan signals as an on-voltage level by respective ones of the plurality of sequential driving signals corresponding to a display area according to an area selection signal that divides the display unit into the display area and a non-display area; and generating respective ones of the plurality of scan signals as an off-voltage level corresponding to the non-display area according to an inverted area selection signal.

The generating of the plurality of sequential driving signals may include generating a plurality of first sequential driving signals and a plurality of second sequential driving signals. The generating of each of the plurality of first sequential driving signals may include outputting one of the second light emitting clock signal or a voltage of a first power source according to a first input signal and the first initialization signal that are input in synchronization with the first light emitting clock signal. The generating of each of the plurality of second sequential driving signals may include outputting one of the first light emitting clock signal or the first power source voltage according to a second input signal and the second initialization signal that are input in synchronization with the second light emitting clock signal.

The first input signal may be the synchronization signal or a corresponding one of the plurality of second sequential driving signals.

The second input signal may be a corresponding one of the plurality of first sequential driving signals.

The generating of the respective ones of the plurality of scan signals as the on-voltage level may include outputting one of the first or second light emitting clock signals as the respective ones of the plurality of scan signals according to corresponding ones of the plurality of sequential driving signals and the area selection signal.

The generating of the respective ones of the plurality of scan signals as the off-voltage level may include outputting a first power source voltage as the respective ones of the plurality of scan signals according to corresponding ones of the plurality of sequential driving signals and the inverted area selection signal.

The method may further include transferring valid data to the plurality of data lines for a period in which the area selection signal corresponding to the display area is applied; and transferring invalid data to the plurality of data lines for a period in which the inverted area selection signal corresponding to the non-display area is applied.

As described above, according to embodiments of the present invention, power consumption can be reduced and a manufacturing process can be simplified.

BRIEF DESCRIPTION OF THE DRAWINGS

The accompanying drawings, together with the specification, illustrate exemplary embodiments of the present invention and, together with the description, serve to explain the principles of aspects of the present invention.

DETAILED DESCRIPTION

Figure 1:
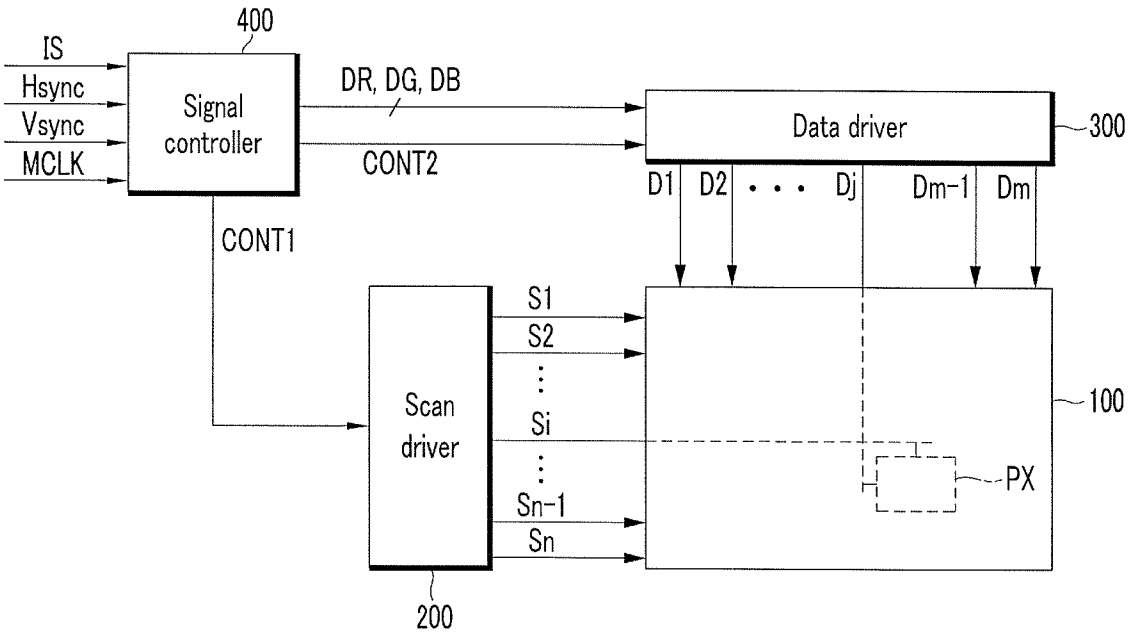
FIG. 1 is a block diagram illustrating a display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Figure 2:
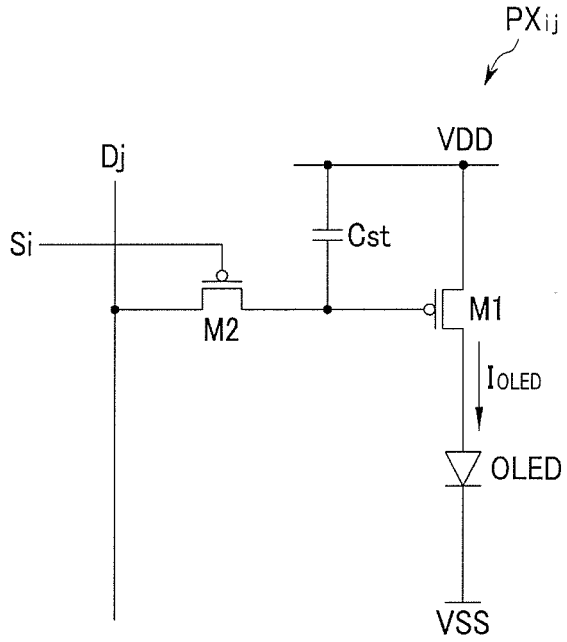
FIG. 2 is an equivalent circuit diagram of a pixel PX that is shown in FIG. 1.
Figure 3:
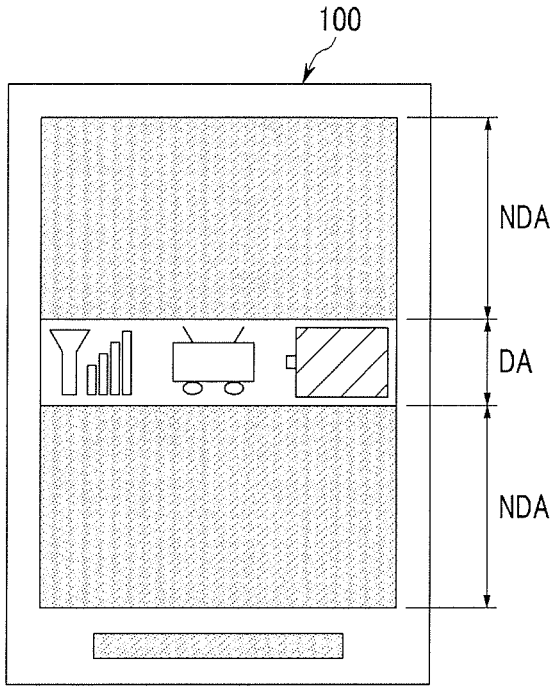
FIG. 3 is a diagram illustrating an image that is displayed in a display unit 100 that is shown in FIG. 1.

FIG. 1 is a block diagram illustrating a display device according to an exemplary embodiment of the present invention, and FIG. 2 is an equivalent circuit diagram of a pixel PX that is shown in FIG. 1. FIG. 3 is a diagram illustrating an image that is displayed in a display unit 100 that is shown in FIG. 1.

Referring to FIG. 1, the display device according to the present exemplary embodiment includes a display unit 100, a scan driver 200, a data driver 300, and a controller 400. The display unit 100 includes a plurality of signal lines S1-Sn and D1-Dm, and a plurality of pixels PX that are coupled thereto and that are arranged in an approximately matrix form from an equivalent circuit perspective. The signal lines S1-Sn and D1-Dm include a plurality of scan lines S1-Sn that transfer scan signals and a plurality of data lines D1-Dm that transfer data signals. The plurality of scan lines S1-Sn extend in an approximately row direction and are substantially parallel to each other, and the plurality of data lines D1-Dm extend in an approximately column direction and are substantially parallel to each other.

At different points in time, the display unit 100 may include a display area DA in which an image is displayed and a non-display area NDA in which an image is not displayed, as shown in FIG. 3. The display unit 100 of FIG. 3 illustrates a standby screen of a mobile phone. In an exemplary embodiment of the present invention, in a standby screen of the mobile phone, the display area is referred to as an area in which icons, etc., display a state of the mobile phone, and the non-display area NDA is referred to as the remaining area of the display unit 100. In an exemplary embodiment of the present invention, the display area DA is illustrated as an area corresponding to, for example, scan lines S4-S8.

Referring to FIG. 2, each pixel PX, for example, a pixel PXij coupled to an i-th (i=1, 2, . . . , n) scan line Si and a j-th (j=1, 2, . . . , m) data line Dj includes an OLED, a driving transistor M1, a capacitor Cst, and a switching transistor M2. The driving transistor M1 receives a driving voltage VDD at a source terminal, and a drain terminal thereof is coupled to an anode terminal of the OLED. A gate terminal of the driving transistor M1 is coupled to a drain terminal of the switching transistor M2. The driving transistor M1 allows a driving current $I_{OLED}$ having a varying intensity according to a voltage that is applied between the gate terminal and the drain terminal to flow to the OLED. A gate terminal of the switching transistor M2 is coupled to the scan line Si, and a source terminal thereof is coupled to the data line Dj. The switching transistor M2 performs a switching operation in response to a scan signal that is applied to the scan line Si, and when the switching transistor M2 is turned on, a data voltage, i.e., a data signal applied to the data line Dj, is transferred to the gate terminal of the driving transistor M1.

The capacitor Cst is coupled between the source terminal and the gate terminal of the driving transistor M1. The capacitor Cst charges a data voltage that is applied to the gate terminal of the driving transistor M1, and even after the switching transistor M2 is turned off, the capacitor Cst sustains the data voltage charge.

The OLED has an anode coupled to an output terminal of the driving transistor M1 and a cathode coupled to a common voltage VSS. The OLED displays an image by emitting light with different intensities according to a current $I_{OLED}$ that is supplied by the driving transistor M1.

The OLED can emit light of one of the primary colors. The primary colors may include, for example, the three primary colors of red (R), green (G), and blue (B), and a desired color can be displayed with a spatial or temporal combination of the three primary colors. In this case, some OLEDs can emit white light, thereby increasing luminance. Alternatively, the OLEDs of all pixels PX can emit white light and some pixels PX can further include a color filter that changes white light that is emitted from an OLED to a colored light (e.g., a red light, a green light, or a blue light).

In the embodiment of FIG. 2, the driving transistor M1 and the switching transistor M2 are p-channel field effect transistors (FET). However, at least one of the switching transistor M2 and the driving transistor M1 may be an n-channel FET.

Further, a coupling relationship of the transistors M1 and M2, the capacitor Cst, and the OLED can be changed. The pixel PXij that is shown in FIG. 2 is an example of a pixel of a display device, and a pixel of another form including at least two transistors and one or more capacitors can be used.

Referring again to FIG. 1, the scan driver 200 is coupled to the scan lines S1-Sn of the display unit 100 and sequentially applies scan signals to the scan lines S1-Sn according to scan control signals CONT1. The scan driver 200 according to the present exemplary embodiment applies scan signals of an on-voltage Von level to scan lines corresponding to the display area DA of the display unit 100 from among the plurality of scan lines S1-Sn and applies scan signals of an off-voltage Voff level to scan lines corresponding to the non-display area NDA. Here, the on-voltage Von is a voltage that can turn on the switching transistor M2, and the off-voltage Voff is a voltage that can turn off the switching transistor M2. Therefore, a pixel PX corresponding to the display area DA emits light and a pixel PX corresponding to the non-display area NDA does not emit light. The scan driver 200 is embodied with P-mos transistors, and a detailed configuration thereof will be described with reference to FIG. 4.

The data driver 300 is coupled to data lines D1-Dm of the display unit 100. The data driver 300 converts image data DR, DG, and DB that are input from the signal controller 400 to data voltages according to data control signals CONT2, and applies the data voltages to the data lines D1-Dm.

The data driver 300 is synchronized with a plurality of scan signals that are input to the display area DA to transfer a plurality of data voltages corresponding to the image data DR, DG, and DB to the plurality of data lines D1-Dm. Further, the data driver 300 transfers a plurality of non-light emitting data voltages to the plurality of data lines for a period in which data voltages are transferred to the non-display area NDA. The data driver 300 can divide a period in which a plurality of data voltages are transferred to the display area DA and the non-display area NDA according to an area selection signal PTA.

For example, the data driver 300 transfers a plurality of data voltages to a plurality of data lines D1-Dm for a period in which a low level area selection signal PTA is input. Similarly, the data driver 300 transfers a plurality of non-light emitting data voltages to a plurality of data lines D1-Dm for a period in which a high level area selection signal PTA (or a low level inverted area selection signal PTB) is input. Hereinafter, a plurality of data voltages that are transferred to the display area DA are referred to as valid data VD, and a plurality of data voltages that are transferred to the non-display area NDA are referred to as invalid data NVD.

A pixel PX structure of an embodiment of the present invention is a voltage-writing type of pixel structure. As such, the data driver 300 generates a plurality of data voltages corresponding to the image data DR, DG, and DB and transfers the data voltages to the plurality of data lines D1-Dm. However, the present invention is not limited thereto. For example, in one embodiment, when the OLED includes a current-writing type of pixel structure, the data driver 300 generates a plurality of data currents corresponding to the image data DR, DG, and DB and transfers the data currents to the plurality of data lines D1-Dm.

The controller 400 receives input signals IS including R, G, and B data, a horizontal synchronization signal Hsync, a vertical synchronization signal Vsync, and a main clock signal MCLK from the outside to generate image data DR, DG, and DB, scan control signals CONT1, and data control signals CONT2.

Figure 4:
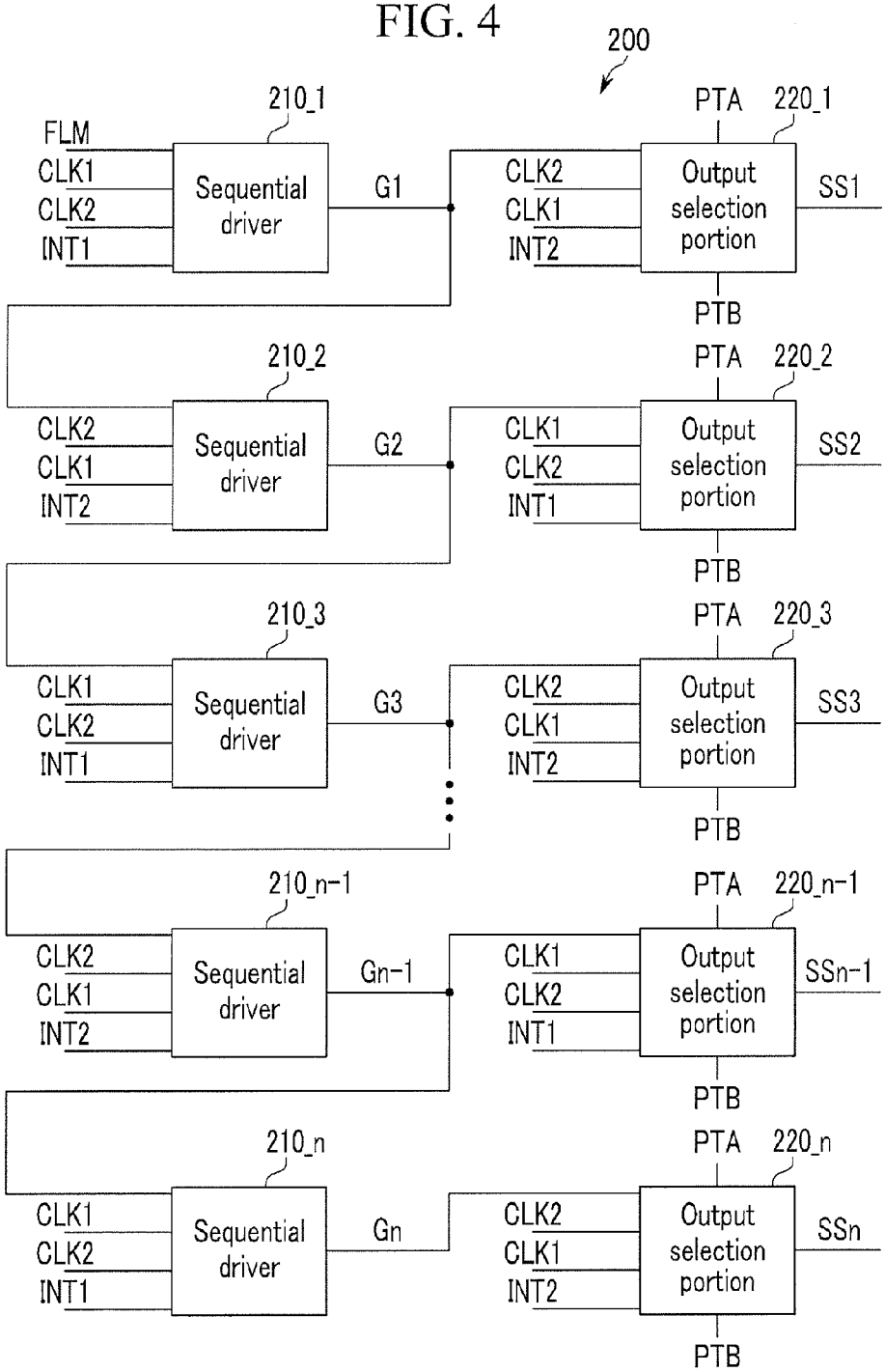
FIG. 4 is a block diagram illustrating a scan driver 200 that is shown in FIG. 1.

The scan control signals CONT1 according to an exemplary embodiment includes a synchronization signal FLM, a first light emitting clock signal CLK1, a second light emitting clock signal CLK2, a first initialization signal INT1, a second initialization signal INT2, an area selection signal PTA, and an inverted area selection signal PTB (as shown in FIG. 4).

Figure 6:
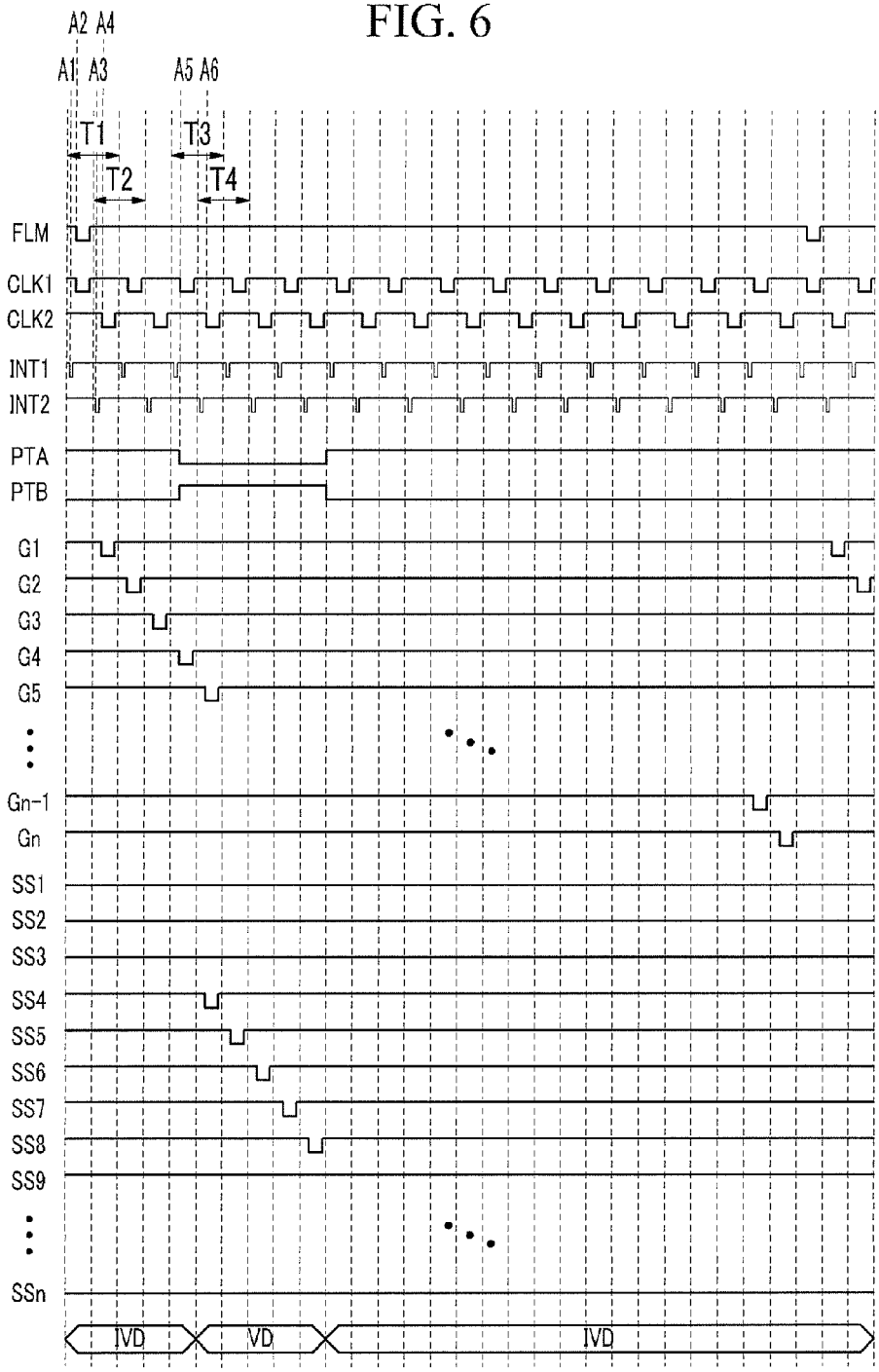
FIG. 6 is a waveform diagram illustrating an operation of the scan driver 200 that is shown in FIG. 1.

The synchronization signal FLM is a signal generated in synchronization with the vertical synchronization signal Vsync, and indicates a starting point of a frame. Here, the vertical synchronization signal Vsync is a signal having a period in which an image of a frame is displayed, and includes a low level pulse that instructs the start of a frame. The synchronization signal FLM includes a low level pulse that is synchronized with a low level pulse of the first light emitting clock signal CLK1 that is first generated at a time point when a low level pulse of the vertical synchronization signal Vsync is generated (as shown in FIG. 6).

The first light emitting clock signal CLK1 includes a plurality of low level pulses that are generated according to a cycle (for example, a set or predetermined cycle). The second light emitting clock signal CLK2 is a clock signal representing the first light emitting clock signal CLK1 shifted by a half cycle. The first and second light emitting clock signals CLK1 and CLK2 have the same frequency.

The first initialization signal INT1 is generated with a phase delay (e.g., a set or predetermined phase delay) relative to the second light emitting dock signal CLK2, and has the same frequency as that of the second light emitting clock signal CLK2. The second initialization signal INT2 is generated with a phase delay (e.g., a set or predetermined phase delay) relative to the first light emitting clock signal CLK1, and has the same frequency as that of the first light emitting clock signal CLK1.

The area selection signal PTA includes information about a display area DA, and is a signal that is generated when scan signals are applied to scan lines corresponding to a display area DA of a plurality of scan lines S1-Sn. The inverted area selection signal PTB is a signal in which the area selection signal PTA is inverted. In an exemplary embodiment of the present invention, for example, when the display area DA is an area corresponding to the scan lines S4-S8, after a synchronization signal FLM is generated, the area selection signal PTA has a low level from a time point when a fourth clock pulse is generated to a time point when an eighth clock pulse is generated.

The data control signals CONT2 include a horizontal synchronization start signal STH that notifies the start of transmitting image data signals DR, DG, and DB for a row of pixels PX to the data driver 300, and a load signal LOAD that instructs the data driver 300 to apply data voltages to the data lines D1-Dm. Further, the data control signals CONT2 according to an exemplary embodiment of the present invention includes a partial data driving signal PD for outputting valid data according to the area selection signal PTA.

FIG. 4 is a block diagram illustrating a scan driver 200 that is shown in FIG. 1.

Referring to FIG. 4, the scan driver 200 includes a plurality of sequential drivers 210_1-210_*n* and a plurality of output selection portions 220_1-220_*n*.

The plurality of sequential drivers 210_1-210_*n* includes a plurality of sequential drivers (210_*x*; x is an odd number) (hereinafter referred to as first sequential drivers) that generates odd-numbered (first) sequential driving signals and a plurality of sequential drivers (210_*y*; y is an even number) (hereinafter referred to as second sequential drivers) that generates even-numbered (second) sequential driving signals among a plurality of sequential driving signals G1-Gn.

Each first sequential driver 210_*x* of the plurality of first sequential drivers receives a first initialization signal INT1 and first and second light emitting clock signals CLK1 and CLK2. Further, each first sequential driver 210_*x* receives a second sequential driving signal Gx−1 output from a second sequential driver 210_*x*−1 among the plurality of second sequential drivers that immediately precedes (e.g. is earlier than and adjacent to) the first sequential driver 210_*x*. First sequential driver 210_*x* is synchronized with the first light emitting clock signal CLK1 to output one of the second light emitting clock signal CLK2 or a first power source voltage VDD as a first sequential driving signal Gx according to a corresponding second sequential driving signal Gx−1 and the first initialization signal INT1.

Here, a first sequential driver 220_1 of the plurality of first sequential drivers receives a synchronization signal FLM instead of a second sequential driving signal. Therefore, the first sequential driver 220_1 is synchronized with the first light emitting clock signal CLK1 to output one of the second light emitting clock signal CLK2 or the first power source voltage VDD as a first sequential driving signal G1 according to the synchronization signal FLM and the first initialization signal INT1.

Each second sequential driver 210_*y* of the plurality of second sequential drivers receives a second initialization signal INT2 and the first and second light emitting clock signals CLK1 and CLK2. Each second sequential driver 210_*y* receives a first sequential driving signal Gy−1 output from a first sequential driver 210_*y*−1 among the plurality of first sequential drivers that immediately precedes (e.g., is earlier than and adjacent to) the second sequential driver 210_*y*. Second sequential driver 210_*y* is synchronized with the second light emitting clock signal CLK2 to output one of the first light emitting clock signal CLK1 or the first power source voltage VDD as a second sequential driving signal Gy according to a corresponding first sequential driving signal Gy−1 and the second initialization signal INT2.

The plurality of output selection portions 220_1-220_*n* includes a plurality of output selection portions (220_*x*; x is an odd number) (hereinafter referred to as first output selection portions) that generates odd-numbered (first) scan signals and a plurality of output selection portions (220_*y*; y is an even number) (hereinafter referred to as second output selection portions) that generates even-numbered (second) scan signals among a plurality of scan signals SS1-SSn.

Each first output selection portion 220_*x* of the plurality of first output selection portions receives an area selection signal PTA, an inverted area selection signal PTB, the second initialization signal INT2, and the first and second light emitting clock signals CLK1 and CLK2. Further, each first output selection portion 220_*x* receives a first sequential driving signal Gx output from a corresponding first sequential driver 210_*x*. The first output selection portion 220_*x* outputs one of the first light emitting clock signal CLK1 or the first power source voltage VDD as a first scan signal SSx according to the corresponding first sequential driving signal Gx, area selection signal PTA, inverted area selection signal PTB, and second initialization signal INT2.

Each second output selection portion 220_*y* of the plurality of second output selection portions receives the area selection signal PTA, the inverted area selection signal PTB, the first initialization signal INT1, and the first and second light emitting clock signals CLK1 and CLK2. Further, each second output selection portion 220_*y* receives a second sequential driving signal Gy output from a corresponding second sequential driver 210_*y*. The second output selection portion 220_*y* outputs one of the second light emitting clock signal CLK2 or the first power source voltage VDD as a second scan signal SSy according to the corresponding second sequential driving signal Gy, area selection signal PTA, inverted area selection signal PTB, and first initialization signal INT1.

Figure 5:
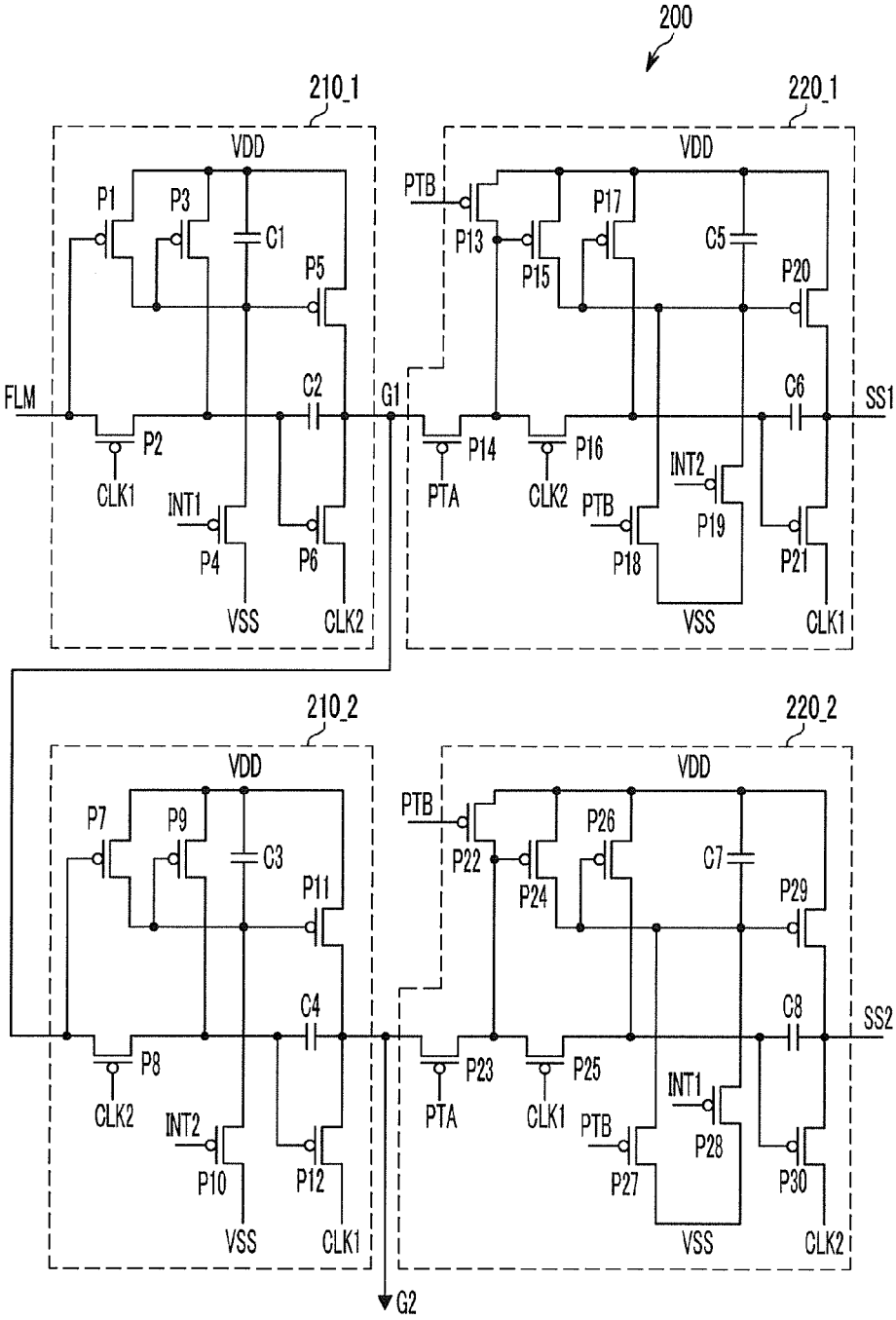
FIG. 5 is a detailed circuit diagram illustrating a configuration of the scan driver 200 that is shown in FIG. 1.

FIG. 5 is a detailed circuit diagram illustrating a configuration of the scan driver 200 that is shown in FIG. 1. For better understanding and ease of description, FIG. 5 illustrates only first and second sequential drivers 210_1 and 210_2 and first and second output selection portions 220_1 and 220_2, but the circuit configuration of the remaining sequential drivers and output selection portions is substantially identical to that of the first and second sequential drivers 210_1 and 210_2 and the first and second output selection portions 220_1 and 220_2.

Referring to FIG. 5, the first sequential driver 210_1 includes a plurality of transistors P1-P6 and a plurality of capacitors C1 and C2. Here, the plurality of transistors P1-P6 are formed as P-mos transistors. The P-mos transistor includes a gate terminal, a source terminal, and a drain terminal, and an electrical connection degree is determined according to a difference between a voltage that is input to the gate terminal and a voltage of the source terminal.

The transistor P1 includes a gate terminal configured to receive a synchronization signal FLM and a source terminal coupled to the first power source VDD. The transistor P2 includes a drain terminal coupled to the gate terminal of the transistor P1 and configured to receive the synchronization signal FLM, a gate terminal configured to receive the first light emitting clock signal CLK1, and a source terminal.

The transistor P3 includes a gate terminal coupled to a drain terminal of the transistor P1, a drain terminal coupled to the source terminal of the transistor P2, and a source terminal coupled to the first power source VDD. The source terminal of the transistor P2 and the drain terminal of the transistor P3 are coupled to a gate terminal of the transistor P6. When the transistor P2 is electrically connected by the first clock signal CLK1, if the synchronization signal FLM is in a low level, the transistor P6 is electrically connected. When the transistor P3 is electrically connected, the transistor P6 is turned off by the first power source voltage VDD.

One terminal (e.g., end or side) of the capacitor C1 is coupled to the first power source VDD. The transistor P4 includes a gate terminal configured to receive a first initialization signal INT1, a drain terminal coupled to a second power source VSS, and a source terminal coupled to an other terminal of the capacitor C1. The transistor P5 includes a gate terminal coupled to the source terminal of the transistor P4 and the other terminal of the capacitor C1, a source terminal coupled to the first power source VDD, and a drain terminal coupled to a source terminal of the transistor P6.

The transistor P6 includes a gate terminal coupled to the one terminal of the capacitor C2 and a drain terminal configured to receive the second light emitting clock signal CLK2. An other terminal of the capacitor C2 is coupled to a source terminal of the transistor P6. A contact point of the drain terminal of the transistor P5 and the source terminal of the transistor P6 becomes an output terminal of the first sequential driving signal G1.

The second sequential driver 210_2 includes a plurality of transistors P7-P12 and a plurality of capacitors C3 and C4. Here, the plurality of transistors P7-P12 are formed as P-mos transistors.

The transistor P7 includes a gate terminal configured to receive the first sequential driving signal G1 and a source terminal coupled to the first power source VDD. The transistor P8 includes a drain terminal coupled to the gate terminal of the transistor P7 and configured to receive the first sequential driving signal G1, a gate terminal configured to receive the second light emitting clock signal CLK2, and a source terminal.

The transistor P9 includes a gate terminal coupled to a drain terminal of the transistor P7, a drain terminal coupled to the source terminal of the transistor P8, and a source terminal coupled to the first power source VDD. The source terminal of the transistor P8 and the drain terminal of the transistor P9 are coupled to a gate terminal of the transistor P12. When the transistor P8 is electrically connected by the second clock signal CLK2, if the first sequential driving signal G1 is in the low level, the transistor P12 is electrically connected. When the transistor P9 is electrically connected, the transistor P12 is turned off by the first power source voltage VDD.

One terminal of the capacitor C3 is coupled to the first power source VDD. The transistor P10 includes a gate terminal configured to receive a second initialization signal INT2, a drain terminal coupled to the second power source VSS, and a source terminal coupled to an other terminal of the capacitor C3. The transistor P11 includes a gate terminal coupled to the source terminal of the transistor P10 and the other terminal of the capacitor C3, a source terminal coupled to the first power source VDD, and a drain terminal coupled to a source terminal of the transistor P12.

The transistor P12 includes a gate terminal coupled to the one terminal of the capacitor C4 and a drain terminal configured to receive the first light emitting clock signal CLK1. An other terminal of the capacitor C4 is coupled to a source terminal of the transistor P12. A contact point of the drain terminal of the transistor P11 and the source terminal of the transistor P12 becomes an output terminal of the second sequential driving signal G2.

The first output selection portion 220_1 includes a plurality of transistors P13-P21 and a plurality of capacitors C5 and C6. Here, the plurality of transistors P13-P21 are formed as P-mos transistors.

The transistor P13 includes a gate terminal configured to receive the inverted area selection signal PTB, a source terminal coupled to the first power source voltage VDD, and a drain terminal coupled to a drain terminal of the transistor P14. The transistor P14 includes a source terminal configured to receive the first sequential driving signal G1 and a gate terminal configured to receive the area selection signal PTA. The transistor P15 includes a gate terminal coupled to the drain terminal of the transistor P13 and a source terminal coupled to the first power source VDD. The transistor P16 includes a source terminal coupled to the drain terminal of the transistor P14 and a gate terminal configured to receive the second light emitting clock signal CLK2.

The transistor P17 includes a gate terminal coupled to a drain terminal of the transistor P15, a source terminal coupled to the first power source VDD, and a drain terminal coupled to a drain terminal of the transistor P16. The transistor P18 includes a gate terminal configured to receive the inverted area selection signal PTB, a drain terminal coupled to the second power source VSS, and a source terminal coupled to the drain terminal of the transistor P15. One terminal of the capacitor C5 is coupled to the first power source VDD. The transistor P19 includes a gate terminal configured to receive the second initialization signal INT2, a drain terminal coupled to the second power source VSS, and a source terminal coupled to an other terminal of the capacitor C5.

The transistor P20 includes a gate terminal coupled to the other terminal of the capacitor C5, a source terminal coupled to the first power source VDD, and a drain terminal coupled to a source terminal of the transistor P21. The transistor P21 includes a gate terminal coupled to one terminal of the capacitor C6 and a drain terminal configured to receive the first light emitting clock signal CLK1. A contact point of the drain terminal of the transistor P20 and the source terminal of the transistor P21 becomes an output terminal of the first scan signal SS1. One terminal of the capacitor C6 is coupled to the gate terminal of the transistor P21, and the other terminal thereof is coupled to the source terminal of the transistor P21.

The second output selection portion 220_2 includes a plurality of transistors P22-P30 and a plurality of capacitors C7 and C8. Here, the plurality of transistors P22-P30 are formed as P-mos transistors.

The transistor P22 includes a gate terminal configured to receive the inverted area selection signal PTB, a source terminal coupled to the first power source VDD, and a drain terminal coupled to a drain terminal of the transistor P23. The transistor P23 includes a source terminal configured to receive the second sequential driving signal G2 and a gate terminal configured to receive the area selection signal PTA. The transistor P24 includes a gate terminal coupled to the drain terminal of the transistor P22 and a source terminal coupled to the first power source VDD. The transistor P25 includes a source terminal coupled to the drain terminal of the transistor P23 and a gate terminal configured to receive the first light emitting clock signal CLK1.

The transistor P26 includes a gate terminal coupled to a drain terminal of the transistor P24, a source terminal coupled to the first power source VDD, and a drain terminal coupled to a drain terminal of the transistor P25. The transistor P27 includes a gate terminal configured to receive the inverted area selection signal PTB, a drain terminal coupled to the second power source voltage VSS, and a source terminal coupled to the drain terminal of the transistor P24. One terminal of the capacitor C7 is coupled to the first power source VDD. The transistor P28 includes a gate terminal configured to receive the first initialization signal INT1, a drain terminal coupled to the second power source voltage VSS, and a source terminal coupled to an other terminal of the capacitor C7.

The transistor P29 includes a gate terminal coupled to the other terminal of the capacitor C7, a source terminal coupled to the first power source VDD, and a drain terminal coupled to a source terminal of the transistor P30. The transistor P30 includes a gate terminal coupled to one terminal of the capacitor C8 and a drain terminal configured to receive the second light emitting clock signal CLK2. A contact point of the drain terminal of the transistor P29 and the source terminal of the transistor P30 becomes an output terminal of the second scan signal SS2. One terminal of the capacitor C8 is coupled to the gate terminal of the transistor P30, and the other terminal thereof is coupled to the source terminal of the transistor P30.

FIG. 6 is a waveform diagram illustrating an operation of the scan driver 200 that is shown in FIG. 1. FIG. 6 is described in relation to a detailed circuit diagram of the scan driver 200 that is shown in FIG. 5. In FIG. 6, a segment T1 and a segment T3 each represent a cycle of the first initialization signal INT1, and a segment T2 and a segment T4 each represent a cycle of the second initialization signal INT2.

Referring to FIG. 6, at a time point A1, when the first initialization signal INT1 is generated in a low level, the transistor P4 is turned on. Accordingly, as the transistor P5 is turned on by the second power source voltage VSS, the first sequential driving signal G1 is generated as the first power source voltage VDD level.

Next, at a time point A2, when the synchronization signal FLM is generated as a pulse of a low level, the first light emitting clock signal CLK1 is generated in a low level. Accordingly, the transistor P2 is turned on, and the transistor P6 is turned on by the synchronization signal FLM. Accordingly, the second light emitting clock signal CLK2 is generated as the first sequential driving signal G1. The first sequential driving signal G1 is generated as the second light emitting clock signal CLK2 for a segment T1, i.e., a cycle of the first initialization signal INT1.

At a time point A3, when the second initialization signal INT2 is generated in a low level, the transistor P10 is turned on. As the transistor P11 is turned on by the second power source voltage VSS, the second sequential driving signal G2 is generated as the first power source voltage VDD level.

Next, at a time point A4, the transistor P8 is turned on by the second light emitting clock signal CLK2 and the transistor P12 is turned on by the first sequential driving signal G1. Accordingly, the first light emitting clock signal CLK1 is generated as the second sequential driving signal G2. The second sequential driving signal G2 is generated as the first light emitting clock signal CLK1 for a segment T2, i.e., a cycle of the second initialization signal INT2. In this way, the sequential driving signals G1-Gn are sequentially output.

For the segment T1 and the segment T2, because the inverted area selection signal PTB is in a low level, the transistor P18 and the transistor P27 are turned on. Accordingly, as the transistor P20 and the transistor P29 are turned on by the second power source voltage VSS, first and second scan signals SS1 and SS2 are generated in the first power source voltage VDD level. In this way, a first scan signal SS3 is generated in the first power source voltage VDD level.

In this state, at a time point A5, when the area selection signal PTA becomes a low level, the transistor P23 is turned on. The transistor P25 is turned on by the first light emitting clock signal CLK1. Accordingly, as the transistor P30 is turned on by a second sequential driving signal G4, the second light emitting clock signal CLK2 is outputted as a second scan signal SS4 for a segment T3.

Likewise, at a time point A6, while the area selection signal PTA remains in the low level (and transistor P14 is turned on), the transistor P16 is turned on by the second light emitting clock signal CLK2. Accordingly, as the transistor P21 is turned on by a first sequential driving signal G5, the first light emitting clock signal CLK1 is generated as a first scan signal SS5 for a segment T4. Continuing in this fashion, for segments in which the area selection signal PTA is in the low level, scan signals SS4-SS8 are sequentially generated.

Therefore, as the scan signal is transferred to only the scan lines S4-S8 corresponding to the display area DA, only the corresponding pixels PX emit light. Further, as the data driver 300 transfers data voltages corresponding to valid data VD to the plurality of data lines D1-Dm only for a segment in which the area selection signal PTA is in a low level, power consumption can be reduced. The display area DA and the non-display area NDA can be arbitrarily selected and driven by the area selection signal PTA.

Figure 7:
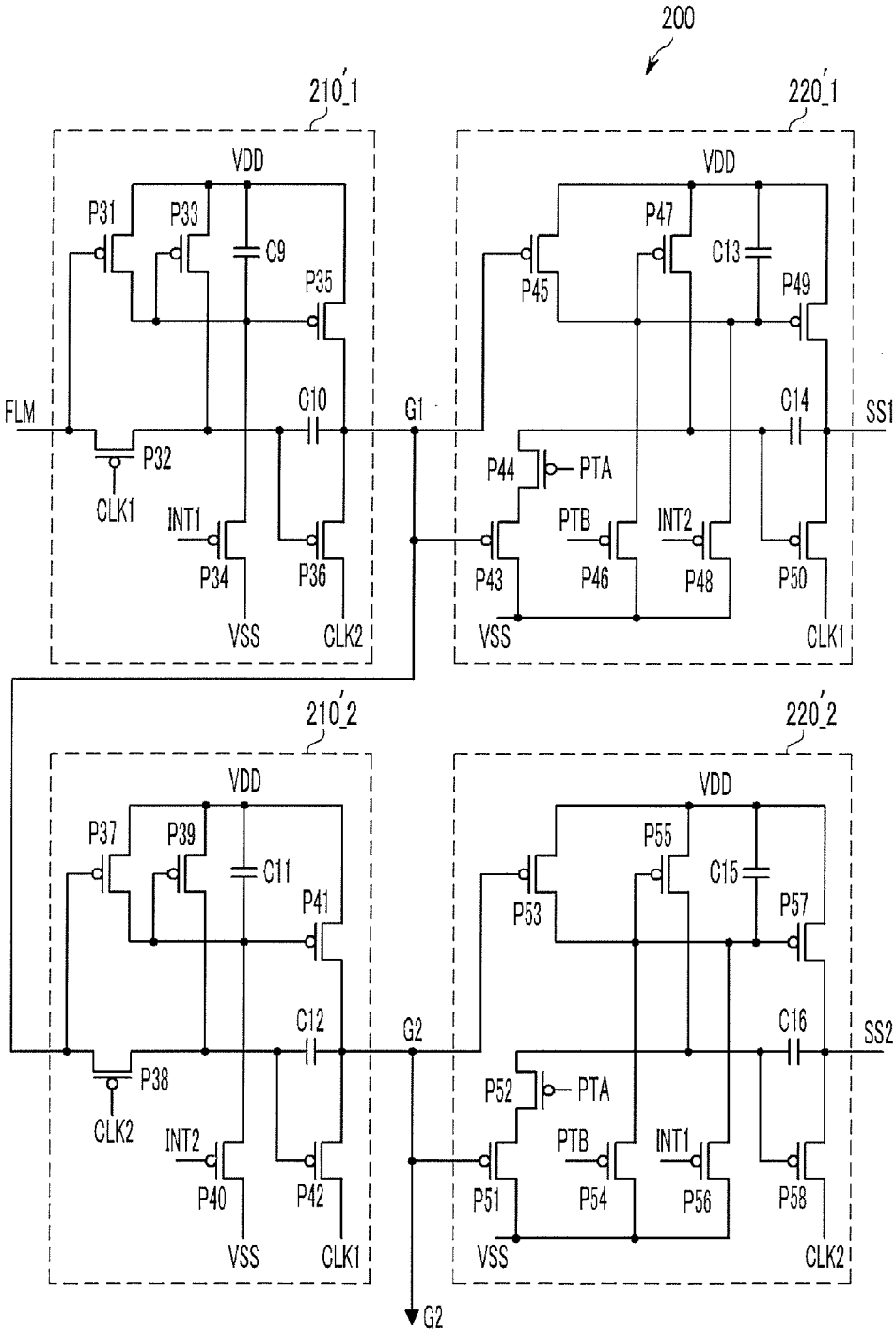
FIG. 7 is a detailed circuit diagram illustrating another configuration of the scan driver 200 that is shown in FIG. 1.

FIG. 7 is a detailed circuit diagram illustrating another configuration of the scan driver 200 that is shown in FIG. 1. FIG. 7 illustrates another configuration of first and second sequential drivers 210'_1 and 210'_2 and first and second output selection portions 220'_1 and 220'_2. For better understanding and ease of description, FIG. 7 illustrates only the first and second sequential drivers 210'_1 and 210'_2 and the first and second output selection portions 220'_1 and 220'_2, but the circuit configuration of the remaining sequential drivers and output selection portions is substantially identical to that of the first and second sequential drivers 210'_1 and 210'_2 and the first and second output selection portions 220'_1 and 220'_2.

Referring to FIG. 7, the first sequential driver 210'_1 includes a plurality of transistors P31-P36 and a plurality of capacitors C9 and C10. Here, the plurality of transistors P31-P36 are formed as P-mos transistors.

The transistor P31 includes a gate terminal configured to receive a synchronization signal FLM and a source terminal coupled to a first power source VDD. The transistor P32 includes a drain terminal coupled to the gate terminal of the transistor P31 and configured to receive the synchronization signal FLM, a gate terminal configured to receive the first light emitting clock signal CLK1, and a source terminal.

The transistor P33 includes a gate terminal coupled to a drain terminal of the transistor P31, a drain terminal coupled to the source terminal of the transistor P32, and a source terminal coupled to the first power source VDD. The source terminal of the transistor P32 and the drain terminal of the transistor P33 are coupled to a gate terminal of the transistor P36. When the transistor P32 is electrically connected by the first clock signal CLK1, if the synchronization signal FLM is in a low level, the transistor P36 is electrically connected. When the transistor P33 is electrically connected, the transistor P36 is turned off by the first power source voltage VDD.

One terminal of the capacitor C9 is coupled to the first power source VDD. The transistor P34 includes a gate terminal configured to receive a first initialization signal INT1, a drain terminal coupled to a second power source VSS, and a source terminal coupled to an other terminal of the capacitor C9. The transistor P35 includes a gate terminal coupled to the source terminal of the transistor P34 and the other terminal of the capacitor C9, a source terminal coupled to the first power source VDD, and a drain terminal coupled to a source terminal of the transistor P36.

The transistor P36 includes a gate terminal coupled to one terminal of the capacitor C10 and a drain terminal configured to receive the second light emitting clock signal CLK2. An other terminal of the capacitor C10 is coupled to the source terminal of the transistor P36. A contact point of the drain terminal of the transistor P35 and the source terminal of the transistor P36 becomes an output terminal of a first sequential driving signal G1.

The second sequential driver 210'_2 includes a plurality of transistors P37-P42 and a plurality of capacitors C11 and C12. Here, the plurality of transistors P37-P42 are formed as P-mos transistors.

The transistor P37 includes a gate terminal configured to receive the first sequential driving signal G1 and a source terminal coupled to the first power source VDD. The transistor P38 includes a drain terminal coupled to the gate terminal of the transistor P37 and configured to receive the first sequential driving signal G1, a gate terminal configured to receive the second light emitting clock signal CLK2, and a source terminal.

The transistor P39 includes a gate terminal coupled to a drain terminal of the transistor P37, a drain terminal coupled to the source terminal of the transistor P38, and a source terminal coupled to the first power source voltage VDD. The source terminal of the transistor P38 and the drain terminal of the transistor P39 are coupled to a gate terminal of the transistor P42. When the transistor P38 is electrically connected by the second clock signal CLK2, if the synchronization signal FLM is in the low level, the transistor P42 is electrically connected. When the transistor P39 is electrically connected, the transistor P42 is turned off by the first power source voltage VDD.

One terminal of the capacitor C11 is coupled to the first power source VDD. The transistor P40 includes a gate terminal configured to receive a second initialization voltage INT2, a drain terminal coupled to the second power source VSS, and a source terminal coupled to an other terminal of the capacitor C11. The transistor P41 includes a gate terminal coupled to the source terminal of the transistor P40 and the other terminal of the capacitor C11, a source terminal coupled to the first power source VDD, and a drain terminal coupled to a source terminal of the transistor P42.

The transistor P42 includes a gate terminal coupled to one terminal of the capacitor C12 and a drain terminal configured to receive the first light emitting clock signal CLK1. An other terminal of the capacitor C12 is coupled to the source terminal of the transistor P42. A contact point of the drain terminal of the transistor P41 and the source terminal of the transistor P42 becomes an output terminal of a second sequential driving signal G2.

The first output selection portion 220'_1 includes a plurality of transistors P43-P50 and a plurality of capacitors C13 and C14. Here, the plurality of transistors P43-P50 are formed as P-mos transistors.

The transistor P43 includes a gate terminal configured to receive the first sequential driving signal G1, a source terminal coupled to a drain terminal of the transistor P44, and a drain terminal coupled to the second power source VSS. The transistor P44 includes a gate terminal configured to receive an area selection signal PTA and a source terminal coupled to a drain terminal of the transistor P47. The transistor P45 includes a gate terminal configured to receive the first sequential driving signal G1 and a source terminal coupled to the first power source voltage VDD. The transistor P46 includes a gate terminal configured to receive an inverted area selection signal PTB, a source terminal coupled to a drain terminal of the transistor P45, and a drain terminal coupled to the second power source VSS.

The transistor P47 includes a gate terminal coupled to the drain terminal of the transistor P45, a source terminal coupled to the first power source VDD, and a drain terminal coupled to the source terminal of the transistor P44. The transistor P48 includes a gate terminal configured to receive the second initialization signal INT2, a source terminal coupled to the gate terminal of the transistor P47, and a drain terminal coupled to the second power source VSS.

One terminal of the capacitor C13 is coupled to the first power source VDD. The transistor P49 includes a gate terminal coupled to an other terminal of the capacitor C13, a source terminal coupled to the first power source VDD, and a drain terminal coupled to a source terminal of the transistor P50. The transistor P50 includes a gate terminal coupled to the source terminal of the transistor P44 and a drain terminal configured to receive the first light emitting clock signal CLK1 is input. A contact point of the drain terminal of the transistor P49 and the source terminal of the transistor P50 becomes an output terminal of the first scan signal SS1. One terminal of the capacitor C14 is coupled to the gate terminal of the transistor P50, and an other terminal thereof is coupled to the source terminal of the transistor P50.

The second output selection portion 220'_2 includes a plurality of transistors P51-P58 and a plurality of capacitors C15 and C16. Here, the plurality of transistors P51-P58 are formed as P-mos transistors.

The transistor P51 includes a gate terminal configured to receive the first sequential driving signal G1, a source terminal coupled to a drain terminal of the transistor P52, and a drain terminal coupled to the second power source voltage VSS. The transistor P52 includes a gate terminal configured to receive the area selection signal PTA and a source terminal coupled to a drain terminal of the transistor P55. The transistor P53 includes a gate terminal configured to receive the second sequential driving signal G2 and a source terminal coupled to the first power source voltage VDD. The transistor P54 includes a gate terminal configured to receive an inverted area selection signal PTB, a source terminal coupled to a drain terminal of the transistor P53, and a drain terminal coupled to the second power source VSS.

The transistor P55 includes a gate terminal coupled to the drain terminal of the transistor P53, a source terminal coupled to the first power source VDD, and a drain terminal coupled to the source terminal of the transistor P52. The transistor P56 includes a gate terminal configured to receive the second initialization signal INT2, a source terminal coupled to the gate terminal of the transistor P55, and a drain terminal coupled to the second power source VSS.

One terminal of the capacitor C15 is coupled to the first power source VDD. The transistor P57 includes a gate terminal coupled to an other terminal of the capacitor C15, a source terminal coupled to the first power source voltage VDD, and a drain terminal coupled to a source terminal of the transistor P58. The transistor P58 includes a gate terminal coupled to the source terminal of the transistor P52 and a drain terminal configured to receive the second light emitting clock signal CLK2. A contact point of the drain terminal of the transistor P57 and the source terminal of the transistor P58 becomes an output terminal of the second scan signal SS2. One terminal of the capacitor C16 is connected to the gate terminal of the transistor P58, and an other terminal thereof is connected to the source terminal of the transistor P58.

Operation of the scan driver 200 having the above-described configuration is described with reference to FIG. 6 as follows. A configuration that outputs a plurality of sequential driving signals G1-Gn is substantially identical to that of an operation description of FIG. 6 and thus a detailed description thereof is not provided again, and a plurality of scan signals SS1-SSn will be described hereinafter.

At a time point A5, when the area selection signal PTA becomes a low level, the transistor P52 is turned on. Then, when the second sequential driving signal G4 becomes a low level, the transistor P51 is also turned on. Accordingly, the transistor P58 is turned on by the second power source voltage VSS and thus, the second light emitting clock signal CLK2 is outputted as a second scan signal SS4 for a segment T3.

Likewise, at a time point A6, while the area selection signal maintains the low level (and transistor P44 is turned on), the transistor P43 is turned on by a first sequential driving signal G5. Accordingly, as the transistor P50 is turned on by the second power source voltage VSS, the first light emitting clock signal CLK1 is outputted as a first scan signal SS5 for a segment T4. Continuing in this fashion, for segments in which the area selection signal PTA is in the low level, scan signals SS4-SS8 are sequentially generated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A display device comprising:

a display unit comprising a plurality of scan lines configured to receive a plurality of scan signals, a plurality of data lines configured to receive a plurality of data signals, and a plurality of pixels coupled to the plurality of scan lines and the plurality of data lines; and a scan driver configured to:

receive, from a source external to the scan driver, a synchronization signal generated in synchronization with a vertical synchronization signal, a first light emitting clock signal, a second light emitting clock signal representing the first light emitting clock signal shifted by a half cycle, a first initialization signal having a same frequency as and a positive first phase delay less than the half cycle relative to the second light emitting clock signal, and a second initialization signal having a same frequency as and a positive second phase delay less than the half cycle relative to the first light emitting clock signal;

generate a plurality of sequential driving signals and the plurality of scan signals;

generate respective ones of the plurality of scan signals as an on-voltage level by respective ones of the plurality of sequential driving signals corresponding to a display area according to an area selection signal that divides the display unit into the display area and a non-display area; and generate respective ones of the plurality of scan signals as an off-voltage level corresponding to the non-display area according to an inverted area selection signal.

2. The display device of claim 1, further comprising a data driver configured to transfer valid data to the plurality of data lines of the display area and to transfer invalid data to the plurality of data lines of the non-display area.

3. The display device of claim 2, wherein the data driver is configured to transfer the valid data to the plurality of data lines for a period in which the area selection signal corresponding to the display area is applied, and to transfer the invalid data to the plurality of data lines for a period in which the inverted area selection signal corresponding to the non-display area is applied.

4. A display device comprising:

a display unit comprising a plurality of scan lines configured to receive a plurality of scan signals, a plurality of data lines configured to receive a plurality of data signals, and a plurality of pixels coupled to the plurality of scan lines and the plurality of data lines; and a scan driver configured to:

receive, from a source external to the scan driver, a synchronization signal generated in synchronization with a vertical synchronization signal, a first light emitting clock signal, a second light emitting clock signal representing the first light emitting clock signal shifted by a half cycle, a first initialization signal having a first phase delay relative to the second light emitting clock signal, and a second initialization signal having a second phase delay relative to the first light emitting clock signal;

generate a plurality of sequential driving signals and the plurality of scan signals;

generate respective ones of the plurality of scan signals as an on-voltage level by respective ones of the plurality of sequential driving signals corresponding to a display area according to an area selection signal that divides the display unit into the display area and a non-display area; and generate respective ones of the plurality of scan signals as an off-voltage level corresponding to the non-display area according to an inverted area selection signal, wherein:

the plurality of scan signals comprises a plurality of first scan signals and a plurality of second scan signals, the plurality of sequential driving signals comprises a plurality of first sequential driving signals and a plurality of second sequential driving signals, and the scan driver comprises:

a plurality of first sequential drivers, each of which is configured to be synchronized with the first light emitting clock signal and configured to output one of the second light emitting clock signal or a voltage of a first power source as a respective one of the plurality of first sequential driving signals according to a first input signal and the first initialization signal;

a plurality of second sequential drivers, each of which is configured to be synchronized with the second light emitting clock signal and configured to output one of the first light emitting clock signal or the first power source voltage as a respective one of the plurality of second sequential driving signals according to a second input signal and the second initialization signal;

a plurality of first output selection portions, each of which is configured to output one of the first light emitting clock signal or the first power source voltage as a respective one of the plurality of first scan signals according to a corresponding one of the plurality of first sequential driving signals, the area selection signal, the inverted area selection signal, and the second initialization signal; and a plurality of second output selection portions, each of which is configured to output one of the second light emitting clock signal or the first power source voltage as a respective one of the plurality of second scan signals according to a corresponding one of the plurality of second sequential driving signals, the area selection signal, the inverted area selection signal, and the first initialization signal.

5. The display device of claim 4, wherein each of the plurality of first sequential drivers is configured to receive, as the first input signal, the synchronization signal or a corresponding immediately preceding one of the plurality of second sequential driving signals.

6. The display device of claim 4, wherein each of the plurality of first sequential drivers comprises:

a first transistor comprising a gate terminal configured to receive the first light emitting clock signal, a first terminal, and a second terminal configured to receive the first input signal;

a second transistor comprising a gate terminal configured to receive the first input signal, a first terminal coupled to the first power source, and a second terminal;

a third transistor comprising a gate terminal coupled to the second terminal of the second transistor, a first terminal coupled to the first power source, and a second terminal;

a first capacitor comprising one terminal coupled to the first power source and an other terminal coupled to the gate terminal of the third transistor;

a fourth transistor comprising a gate terminal coupled to the other terminal of the first capacitor, a first terminal coupled to the first power source, and a second terminal;

a fifth transistor comprising a gate terminal configured to receive the first initialization signal, a first terminal coupled to the other terminal of the first capacitor, and a second terminal coupled to a second power source;

a second capacitor comprising one terminal coupled to the second terminal of the fourth transistor and an other terminal coupled to the second terminal of the third transistor; and a sixth transistor comprising a gate terminal coupled to the one terminal of the second capacitor, a first terminal coupled to the other terminal of the second capacitor, and a second terminal configured to receive the second light emitting clock signal.

7. The display device of claim 4, wherein each of the plurality of second sequential drivers is configured to receive, as the second input signal, a corresponding immediately preceding one of the plurality of first sequential driving signals.

8. The display device of claim 4, wherein each of the plurality of second sequential drivers comprises:

a first transistor comprising a gate terminal configured to receive the second light emitting clock signal, a first terminal, and a second terminal configured to receive the second input signal;

a second transistor comprising a gate terminal configured to receive the second input signal, a first terminal coupled to the first power source, and a second terminal;

a third transistor comprising a gate terminal coupled to the second terminal of the second transistor, a first terminal coupled to the first power source, and a second terminal;

a first capacitor comprising one terminal coupled to the first power source and an other terminal coupled to the gate terminal of the third transistor;

a fourth transistor comprising a gate terminal coupled to the other terminal of the first capacitor, a first terminal coupled to the first power source, and a second terminal;

a fifth transistor comprising a gate terminal configured to receive the second initialization signal, a first terminal coupled to the other terminal of the first capacitor, and a second terminal coupled to a second power source;

a second capacitor comprising one terminal coupled to the second terminal of the fourth transistor and an other terminal coupled to the second terminal of the third transistor; and a sixth transistor comprising a gate terminal coupled to the one terminal of the second capacitor, a first terminal coupled to the other terminal of the second capacitor, and a second terminal configured to receive the first light emitting clock signal.

9. The display device of claim 4, wherein each of the plurality of first output selection portions comprises:

a first transistor comprising a gate terminal configured to receive the area selection signal, a first terminal configured to receive a corresponding one of the first sequential driving signals, and a second terminal;

a second transistor comprising a gate terminal configured to receive the inverted area selection signal, a first terminal coupled to the first power source, and a second terminal coupled to the second terminal of the first transistor;

a third transistor comprising a gate terminal coupled to the second terminal of the second transistor, a first terminal coupled to the first power source, and a second terminal;

a fourth transistor comprising a gate terminal configured to receive the second light emitting clock signal, a first terminal coupled to the second terminal of the second transistor, and a second terminal;

a fifth transistor comprising a gate terminal coupled to the second terminal of the third transistor, a first terminal coupled to the first power source, and a second terminal coupled to the second terminal of the fourth transistor;

a sixth transistor comprising a gate terminal configured to receive the inverted area selection signal, a first terminal coupled to the gate terminal of the fifth transistor, and a second terminal coupled to a second power source;

a first capacitor comprising one terminal coupled to the first power source and an other terminal coupled to the first terminal of the sixth transistor;

a seventh transistor comprising a gate terminal configured to receive the second initialization signal, a first terminal coupled to the other terminal of the first capacitor, and a second terminal coupled to the second power source;

an eighth transistor comprising a gate terminal coupled to the other terminal of the first capacitor, a first terminal coupled to the first power source, and a second terminal;

a second capacitor comprising one terminal coupled to the second terminal of the fifth transistor and an other terminal coupled to the second terminal of the eighth transistor; and a ninth transistor comprising a gate terminal coupled to the one terminal of the second capacitor, a first terminal coupled to the other terminal of the second capacitor, and a second terminal configured to receive the second light emitting clock signal.

10. The display device of claim 4, wherein each of the plurality of first output selection portions comprises:

a first transistor comprising a gate terminal configured to receive a corresponding one of the first sequential driving signals, a first terminal, and a second terminal coupled to a second power source;

a second transistor comprising a gate terminal configured to receive the area selection signal, a first terminal, and a second terminal coupled to the first terminal of the first transistor;

a third transistor comprising a gate terminal configured to receive the corresponding one of the first sequential driving signals, a first terminal coupled to the first power source, and a second terminal;

a fourth transistor comprising a gate terminal coupled to the second terminal of the third transistor, a first terminal coupled to the first power source, and a second terminal coupled to the first terminal of the second transistor;

a fifth transistor comprising a gate terminal configured to receive the inverted area selection signal, a first terminal coupled to the gate terminal of the fourth transistor, and a second terminal coupled to the second power source;

a sixth transistor comprising a gate terminal configured to receive the second initialization signal, a first terminal coupled to the gate terminal of the fourth transistor, and a second terminal coupled to the second power source;

a first capacitor comprising one terminal coupled to the first power source and an other terminal coupled to the first terminal of the sixth transistor;

a seventh transistor comprising a gate terminal coupled to the other terminal of the first capacitor, a first terminal coupled to the first power source, and a second terminal;

a second capacitor comprising one terminal coupled to the second terminal of the fourth transistor and an other terminal coupled to the second terminal of the seventh transistor; and an eighth transistor comprising a gate terminal coupled to the one terminal of the second capacitor, a first terminal coupled to the other terminal of the second capacitor, and a second terminal configured to receive the second light emitting clock signal.

11. The display device of claim 4, wherein each of the plurality of second output selection portions comprises:

a first transistor comprising a gate terminal configured to receive the area selection signal, a first terminal configured to receive a corresponding one of the second sequential driving signals, and a second terminal;

a second transistor comprising a gate terminal configured to receive the inverted area selection signal, a first terminal coupled to the first power source voltage, and a second terminal coupled to the second terminal of the first transistor;

a third transistor comprising a gate terminal coupled to the second terminal of the second transistor, a first terminal coupled to the first power source voltage, and a second terminal;

a fourth transistor comprising a gate terminal configured to receive the first light emitting clock signal, a first terminal coupled to the second terminal of the second transistor, and a second terminal;

a fifth transistor comprising a gate terminal coupled to the second terminal of the third transistor, a first terminal coupled to the first power source, and a second terminal coupled to the second terminal of the fourth transistor;

a sixth transistor comprising a gate terminal configured to receive the inverted area selection signal, a first terminal coupled to the gate terminal of the fifth transistor, and a second terminal coupled to a second power source;

a first capacitor comprising one terminal coupled to the first power source and an other terminal coupled to the first terminal of the sixth transistor;

a seventh transistor comprising a gate terminal configured to receive the first initialization signal, a first terminal coupled to the other terminal of the first capacitor, and a second terminal coupled to the second power source;

an eighth transistor comprising a gate terminal coupled to the other terminal of the first capacitor, a first terminal coupled to the first power source, and a second terminal;

a second capacitor comprising one terminal coupled to the second terminal of the fifth transistor and an other terminal coupled to the second terminal of the eighth transistor; and a ninth transistor comprising a gate terminal coupled to the one terminal of the second capacitor, a first terminal coupled to the other terminal of the second capacitor, and a second terminal configured to receive the second light emitting clock signal.

12. The display device of claim 4, wherein each of the plurality of second output selection portions comprises:

a first transistor comprising a gate terminal configured to receive a corresponding one of the second sequential driving signals, a first terminal, and a second terminal coupled to a second power source;

a second transistor comprising a gate terminal configured to receive the area selection signal, a first terminal, and a second terminal coupled to the first terminal of the first transistor;

a third transistor comprising a gate terminal configured to receive the corresponding one of the second sequential driving signals, a first terminal coupled to the first power source, and a second terminal;

a fourth transistor comprising a gate terminal coupled to the second terminal of the third transistor, a first terminal coupled to the first power source, and a second terminal coupled to the first terminal of the second transistor;

a fifth transistor comprising a gate terminal configured to receive the inverted area selection signal, a first terminal coupled to the gate terminal of the fourth transistor, and a second terminal coupled to the second power source;

a sixth transistor comprising a gate terminal configured to receive the second initialization signal, a first terminal coupled to the gate terminal of the fourth transistor, and a second terminal coupled to the second power source;

a first capacitor comprising one terminal coupled to the first power source and an other terminal coupled to the first terminal of the sixth transistor;

a seventh transistor comprising a gate terminal coupled to the other terminal of the first capacitor, a first terminal coupled to the first power source, and a second terminal;

a second capacitor comprising one terminal coupled to the second terminal of the fourth transistor and an other terminal coupled to the second terminal of the seventh transistor; and an eighth transistor comprising a gate terminal coupled to the one terminal of the second capacitor, a first terminal coupled to the other terminal of the second capacitor, and a second terminal configured to receive the second light emitting clock signal.

13. A method of driving a display device comprising a scan driver and a display unit comprising a plurality of scan lines configured to receive a plurality of scan signals from the scan driver, a plurality of data lines configured to receive a plurality of data signals, and a plurality of pixels coupled to the plurality of scan lines and the plurality of data lines, the method comprising:

receiving by the scan driver, from a source external to the scan driver, a synchronization signal that is generated in synchronization with a vertical synchronization signal, a first light emitting clock signal, a second light emitting clock signal representing the first light emitting clock signal shifted by a half cycle, a first initialization signal having a same frequency as and a positive first phase delay less than the half cycle relative to the second light emitting clock signal, and a second initialization signal having a same frequency as and a positive second phase delay less than the half cycle relative to the first light emitting clock signal;

generating by the scan driver a plurality of sequential driving signals; and generating by the scan driver the plurality of scan signals, the generating by the scan driver of the plurality of scan signals comprising:

generating by the scan driver respective ones of the plurality of scan signals as an on-voltage level by respective ones of the plurality of sequential driving signals corresponding to a display area according to an area selection signal that divides the display unit into the display area and a non-display area; and generating by the scan driver respective ones of the plurality of scan signals as an off-voltage level corresponding to the non-display area according to an inverted area selection signal.

14. The method of claim 13, wherein the generating by the scan driver of the respective ones of the plurality of scan signals as the on-voltage level comprises outputting by the scan driver one of the first or second light emitting clock signals as the respective ones of the plurality of scan signals according to corresponding ones of the plurality of sequential driving signals and the area selection signal.

15. The method of claim 13, wherein the generating by the scan driver of the respective ones of the plurality of scan signals as the off-voltage level comprises outputting by the scan driver a first power source voltage as the respective ones of the plurality of scan signals according to corresponding ones of the plurality of sequential driving signals and the inverted area selection signal.

16. The method of claim 13, further comprising:

transferring valid data to the plurality of data lines for a period in which the area selection signal corresponding to the display area is applied; and transferring invalid data to the plurality of data lines for a period in which the inverted area selection signal corresponding to the non-display area is applied.

17. A method of driving a display device comprising a scan driver and a display unit comprising a plurality of scan lines configured to receive a plurality of scan signals from the scan driver, a plurality of data lines configured to receive a plurality of data signals, and a plurality of pixels coupled to the plurality of scan lines and the plurality of data lines, the method comprising:

receiving by the scan driver, from a source external to the scan driver, a synchronization signal that is generated in synchronization with a vertical synchronization signal, a first light emitting clock signal, a second light emitting clock signal representing the first light emitting clock signal shifted by a half cycle, a first initialization signal having a first phase delay relative to the second light emitting clock signal, and a second initialization signal having a second phase delay relative to the first light emitting clock signal;

generating by the scan driver a plurality of sequential driving signals; and generating by the scan driver the plurality of scan signals, the generating by the scan driver of the plurality of scan signals comprising:

generating by the scan driver respective ones of the plurality of scan signals as an on-voltage level by respective ones of the plurality of sequential driving signals corresponding to a display area according to an area selection signal that divides the display unit into the display area and a non-display area; and generating by the scan driver respective ones of the plurality of scan signals as an off-voltage level corresponding to the non-display area according to an inverted area selection signal, wherein the generating by the scan driver of the plurality of sequential driving signals comprises generating by the scan driver a plurality of first sequential driving signals and a plurality of second sequential driving signals, wherein:

the generating by the scan driver of each of the plurality of first sequential driving signals comprises outputting by the scan driver one of the second light emitting clock signal or a voltage of a first power source according to a first input signal and the first initialization signal that are input in synchronization with the first light emitting clock signal; and the generating by the scan driver of each of the plurality of second sequential driving signals comprises outputting by the scan driver one of the first light emitting clock signal or the first power source voltage according to a second input signal and the second initialization signal that are input in synchronization with the second light emitting clock signal.

18. The method of claim 17, wherein the first input signal is the synchronization signal or a corresponding one of the plurality of second sequential driving signals.

19. The method of claim 17, wherein the second input signal is a corresponding one of the plurality of first sequential driving signals.

* * * * *